US007406986B2

(12) United States Patent
Lam

(10) Patent No.: US 7,406,986 B2
(45) Date of Patent: Aug. 5, 2008

(54) WOVEN TAPE FOR TRIMMING OF A BRASSIERE

(75) Inventor: Ah Ping Lam, Guangdong (CN)

(73) Assignee: Pioneer Elastic Fabric Ltd., New Territories (HK)

( * ) Notice: Subject to any disclaimer, the term of this patent is extended or adjusted under 35 U.S.C. 154(b) by 0 days.

(21) Appl. No.: 10/885,097

(22) Filed: Jul. 7, 2004

(65) Prior Publication Data

US 2005/0061386 A1 Mar. 24, 2005

(30) Foreign Application Priority Data

Sep. 22, 2003 (CN) ..... 03 1 46884

(51) Int. Cl.
*D03D 3/00* (2006.01)

(52) U.S. Cl. ..... 139/384 R; 139/387 R; 139/383 R

(58) Field of Classification Search ..... 139/387 R, 139/384 R, 383 R; 450/72, 77, 79, 58, 18, 450/26, 28, 13, 17, 82, 73, 80; 24/199, 200, 24/265 BC See application file for complete search history.

(56) References Cited

U.S. PATENT DOCUMENTS 1,486,816 A * 3/1924 Bosebeck et al. ..... 87/10
1,605,760 A * 11/1926 Newman ..... 139/387 R
2,042,046 A * 5/1936 Gwathmey ..... 112/409
2,738,509 A * 3/1956 Bauder ..... 450/82
3,076,463 A * 2/1963 Vorsteher ..... 450/77
3,209,370 A * 10/1965 Miller ..... 2/232
3,467,107 A * 9/1969 Butvinik et al. ..... 450/77
3,591,866 A * 7/1971 Jensen ..... 2/321
4,592,118 A * 6/1986 DeWoskin ..... 24/444
5,642,178 A * 6/1997 Leonardi et al. ..... 351/111
6,827,628 B2 * 12/2004 Kaye et al. ..... 450/86

FOREIGN PATENT DOCUMENTS

| | | |
|---|---|---|
| FR | 2170995 | 9/1973 |
| GB | 416628 | 9/1934 |
| JP | 08 325887 | 12/1996 |

* cited by examiner

*Primary Examiner*—Gary L. Welch
*Assistant Examiner*—Andrew W Sutton
(74) *Attorney, Agent, or Firm*—Buchanan Ingersoll & Rooney PC

(57) ABSTRACT

A woven tape for use as a trimming of a brassiere is disclosed as including a body portion provided with a number of openings along its warpwise centerline. An advantage in the use of a woven tape according to this invention as a trimming of a brassiere is that its position relative to the bra body can be adjustable, thus allowing choices to a user, and offering both enhanced convenience and aesthetic appearance.

4 Claims, 5 Drawing Sheets

WOVEN TAPE FOR TRIMMING OF A BRASSIERE

FIELD OF THE INVENTION

This invention involves a woven tape, especially a woven tape used for the trimming of a brassiere (bra).

BACKGROUND OF THE INVENTION

Woven tapes are extensively used in the textile industry and other aspects of daily life. It is particularly widely used in the garment industry. For example, existing bras need narrow elastic woven tapes for the trimming of the bra body or for the shoulder straps for fixing the bra.

In general, there are two ways to connect the shoulder straps with the bra body. One of the methods is to integrate the straps with the bra body by direct sewing. The position of the shoulder straps of this kind of bra is fixed and cannot be detached. This will frequently bring inconvenience to a user wearing a thin-strap vest or a bare top. Another method is to use a movable device, in that the bra body is equipped with shackles and the shoulder straps are sewed with "9"-shaped hooks, so that the shoulder straps can be detached from or hooked on to the bra body according to different needs in use. This kind of bra is commonly called a dual-purpose brassiere.

Although this kind of dual-purpose bra solves, to a certain extent, the problem of the exposure of the shoulder straps when wearing a thin-strap vest or a bare top, it is obviously inconvenient to users of different body shapes or different wearing needs, because the user can only choose between detaching or attaching the shoulder straps, but it is impossible for her to adjust the positions where the shoulder straps are attached to the bra body as she pleases according to the current need. In addition, the shackles are left on the bra body of the dual-purpose bra after the straps are detached, which affects the appearance of the bra. At present, there is no woven tape which can satisfactorily solve the above mentioned problem by allowing a user, when using wearing a bra incorporating such a woven tape, to adjust the positions where the shoulder straps are engaged with the bra body.

SUMMARY OF THE INVENTION

According to the present invention, there is provided a woven tape for use as trimming of a brassiere, said woven tape including a body portion provided with a plurality of openings along its warpwise centerline.

This invention is aimed at providing a woven tape which can be used for the trimming of a brassiere, allowing the hooking positions to be changed as the user pleases.

Advantageously, the openings may be formed integrally with said woven tape by weaving.

Conveniently, a position for engagement with a hook may be constituted by two adjacent openings.

Suitably, said woven tape may include a plurality of said engagement positions.

Said body portion of said woven tape may advantageously be of a double-layer structure folded along said warpwise centerline. The body portion of said woven tape may conveniently be sealed on both sides.

Said double-layer structure may suitably have a bottom section which is a sealed double layer.

Said tape edge may be a single-layer woven tape, or a double-layer woven tape. Said woven tape may be an elastic woven tape, or a non-elastic woven tape.

BRIEF DESCRIPTION OF THE DRAWINGS

Embodiments of woven tapes according to the present invention will now be described, by way of examples only, with reference to the accompanying drawings, in which.

DESCRIPTION OF THE PREFERRED EMBODIMENTS

Figure 9A:
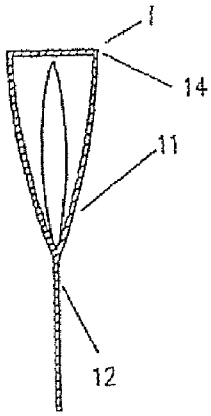
FIG. 9*a* is a cross-sectional view taken along the line A-A in FIG. 8.
Figure 9B:
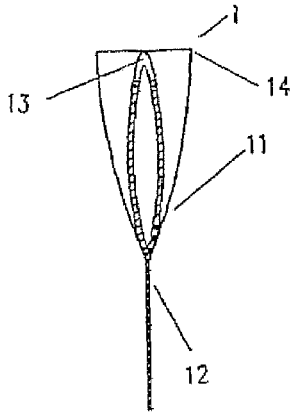
FIG. 9*b* is a cross-sectional view taken along the line B-B in FIG. 8.
Figure 10A:
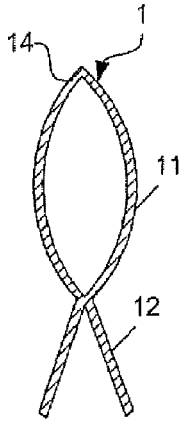
FIGS. 10A and 10B are cross sectional views of a woven tape taken along the lines A-A and B-B in FIG. 8, respectively, according to the present invention.
Figure 10B:
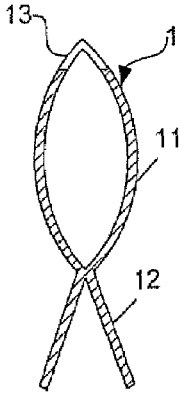

A woven tape according to the present invention may be elastic or non-elastic, and their manufacturing methods are similar. An elastic woven tape according to a first embodiment of the present invention will be described first below.

elastic woven tapes according to the present invention, and as shown in FIG. 8, FIG. 9*a*, FIG. 9*b*, FIG. 10A and FIG. 10B, include a double-layer structure 11. Along the upper section of the woven tape are alternately arranged openings 13 and hooking positions 14, and along a lower section of the woven tape is integrally woven with a sealed double-layer section 12 which is to be sewn with the bra body. FIGS. 10A and 10B show cross sectional views of an elastic woven tape, taken along the lines A-A and B-B in FIG. 8, respectively. As depicted in FIGS. 10A and 10B, the double-layer section 12 of one embodiment of the woven tape has open lower sides. The hooking position 14 is used for attachment with a "9"-shaped hook and the opening 13 is used for entry or exit of the hook. The double-layer structure 11, sealed double-layer section 12, openings 13 and hooking positions 14 are integrally formed with one another by weaving instead of sewing, so there are no joints between the parts.

The sealed double layer section can be woven into the form of a single-layer elastic tape, as shown in FIG. 9*a* and FIG. 9*b*, or be woven into the form of a double-layer elastic tape, as shown in FIG. 10.

Figure 1:
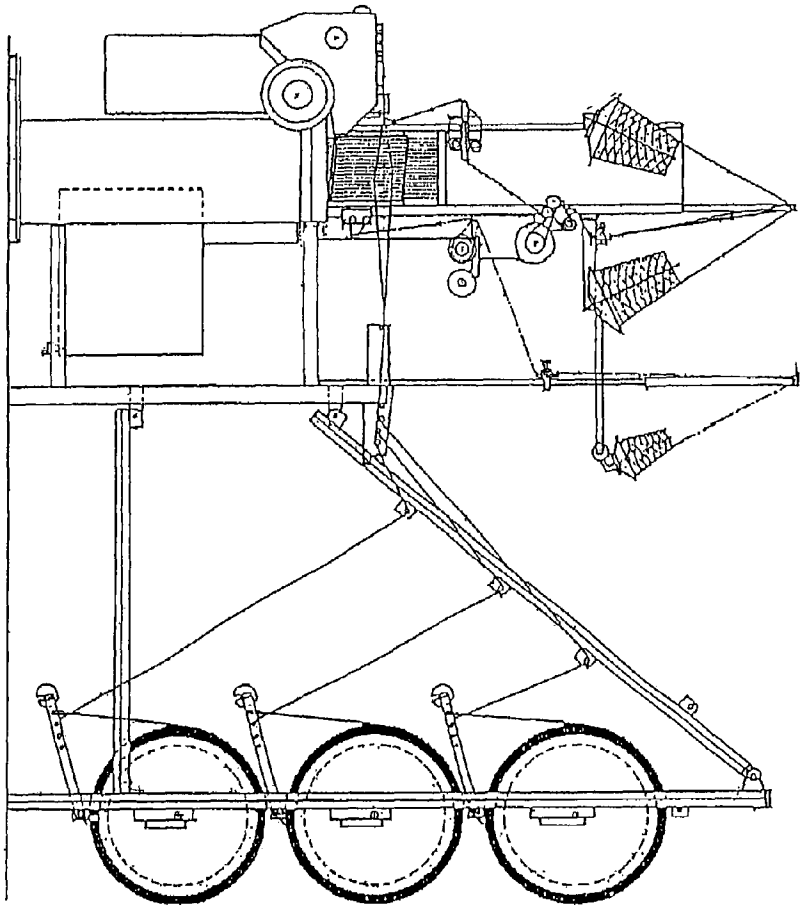
FIG. 1 shows the schematic structure of a shuttleless loom which can be used for production of a woven tape according to the present invention.
Figure 2:
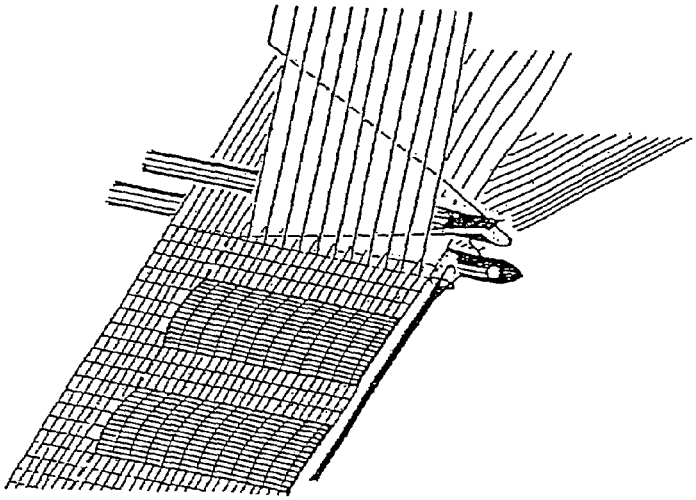
FIG. 2 shows double weft needles.
Figure 3:
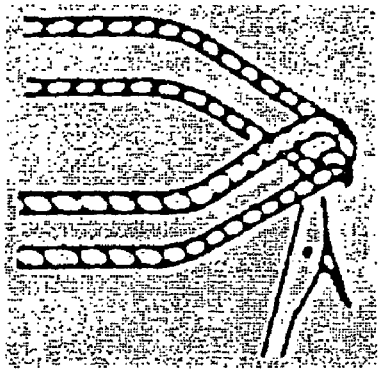
FIG. 3 shows a binding method with a single latch needle and without binder threads.

FIG. 1 shows a schematic view of a Swiss Muller Model NF shuttleless loom used in the production of a woven tape according to the present invention. The weaving of this woven tape is realized in the matched binding way by means of the weaving structure of the fabric. A binding method, which can be used in this invention, is described below. A double weft needles method, as shown in FIG. 2, must be used for this woven tape and there are many binding ways, e.g. a way with single latch needle and without binder threads as shown in FIG. 3.

Figure 11:
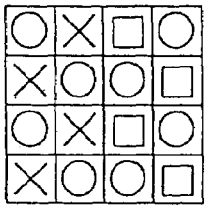
FIG. 11 shows the weaving structure of the double-ply structure shown in FIG. 8.

A diagram showing the specific weaving structure of the double-layer structure 11 is shown in FIG. 11, in which "X" means the warp yarn is above two weft yarns; "○" means the warp yarn is between two weft yarns; and "□" means the warp yarn is underneath two weft yarns.

Figure 12:
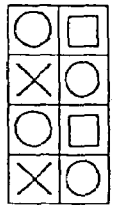
FIG. 12 shows the weaving structure of the openings shown in FIG. 8.

The specific weaving structure of the opening 13 is shown in FIG. 12, in which "X" means the warp yearn is above two weft yarns; "○" means the warp yarn is between two weft yarns; and "□" means the warp yarn is underneath two weft yarns.

Figure 13:
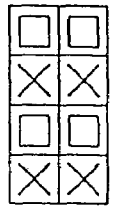
FIG. 13 shows the weaving structure of the hooking positions shown in FIG. 8.

The specific weaving structure of a hooking position 14 is shown in FIG. 13, in which "X" means the warp yarn is above two weft yarns; "○" means the warp yarn between two weft yarns; and "□" means the warp yarn is underneath the two weft yarns.

Figure 14:
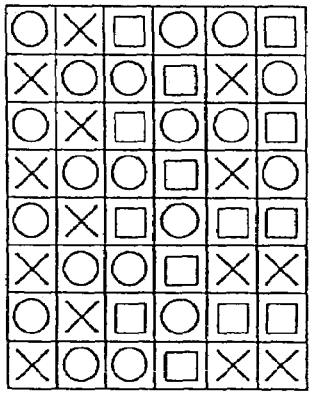
FIG. 14 shows the weaving structure of the double-layer structure and the openings integrated with the hooking positions by weaving.
Figure 15:
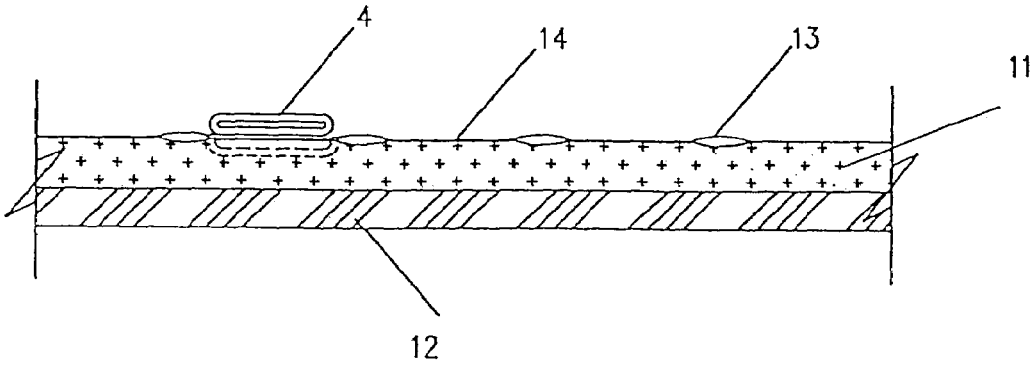
FIG. 15 shows a woven tape according to the present invention when in actual use.

The weaving structure of the integrally woven double-layer structure, openings 13, and hooking positions 14 is shown in FIG. 14, in which "X" means the warp yarn is above two weft yarns; "○" means the warp yarn is between two weft yarns; and "□" means the warp yarn is underneath two weft yarns.

The lengths of the openings 13 and hooking positions 14 can be decided according to the size of the hook.

The woven tape can be woven with characters, patterns, graphic designs, numerals or letters according to the demand of the market so as to enhance its appearance.

Woven tapes according to this invention can be extensively used in the textile industry and other industries, and are especially suitable for the trimming of a lady's brassiere. A woven tape according to the present invention may be engaged with a bra body 2 in various configurations and positions, as shown in FIG. 15, FIG. 16, FIG. 17 and FIG. 18. When an elastic fabric according to this invention is sewn onto the upper edge of the respective cup of the bra body 2, which seems not to be different in appearance from an ordinary bra. However, as the woven tape 1 has a number of hooking positions 14 and openings 13, the bra is equipped with a number of hidden hooking positions 14 for engagement with the shoulder straps 3. Shoulder straps 3 with "9"-shaped hooks 4 can be hooked onto the hooking positions 14 of the woven tape as the user pleases so as to adjust the wearing of the bra.

Figure 16:
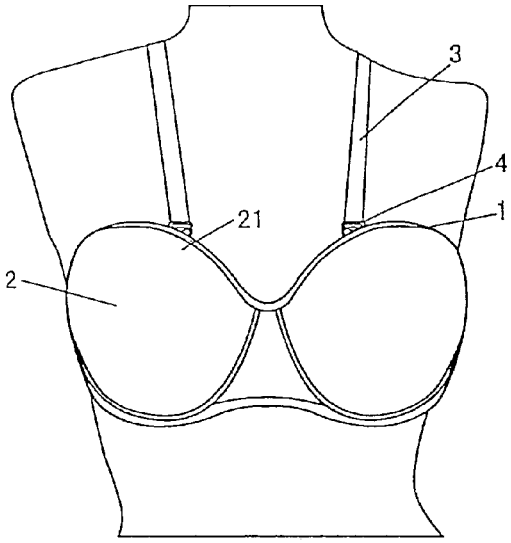
FIG. 16 shows a bra body sewn with a woven tape according to the present invention, when engaged with the shoulder straps in a first configuration.
Figure 17:
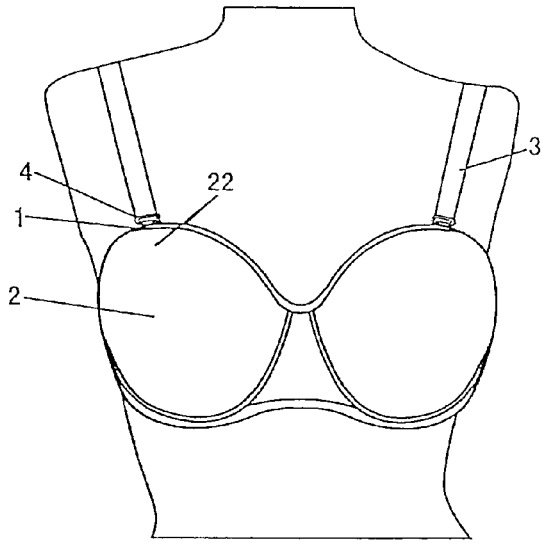
FIG. 17 shows the bra body shown in FIG. 16 engaged with the shoulder straps in a second configuration.
Figure 18:
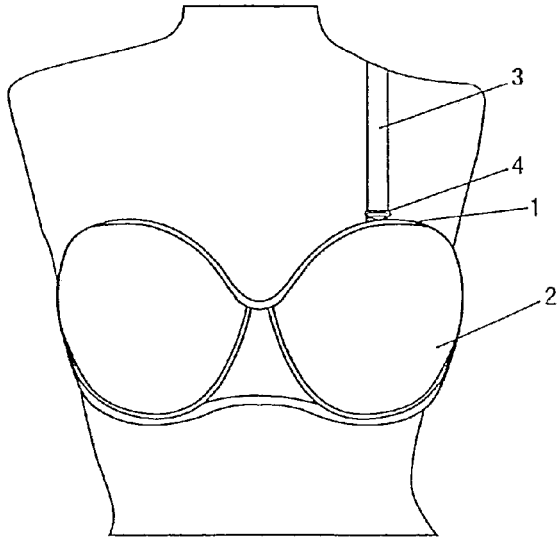
FIG. 18 shows the bra body shown in FIG. 16 engaged with the shoulder straps in a third configuration.

As shown in FIG. 16, a user may hook the shoulder straps 3 in the positions close to the middle 21 of the bra body 2. This arrangement suits a lady wearing a high-collar bare-top blouse. As shown in FIG. 17, a user may also hook the shoulder straps 3 in positions close to both sides 22 of the bra body 2. This arrangement is suitable for a lady wearing a wide-collar blouse. As shown in FIG. 18, a user may remove one shoulder strap 3, with only one should strap 3 left. This arrangement is suitable for a lady wearing a dress with one shoulder bare.

As the bra with the shoulder straps 3 removed has no shackles left on it, it still looks neat and beautiful, and is natural and comfortable to wear. In a nutshell, this invention is used for the trimming of a bra, so as to allow flexibility and convenience in using the bra, and various ways and modifications may be taken according to different needs of the user.

Figure 4:
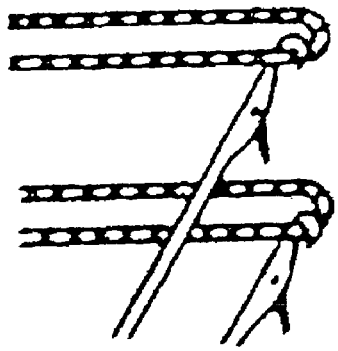
FIG. 4 shows a binding method with a double latch needle and without binder threads.

As shown in FIG. 4, the binding method of double weft needles in combination with double latch needles without binder threads can also be used for weaving the woven tape. A side view of a woven tape resulting from this binding method is shown in FIG. 9*b*, whose edge is of a double-layer structure.

Figure 5:
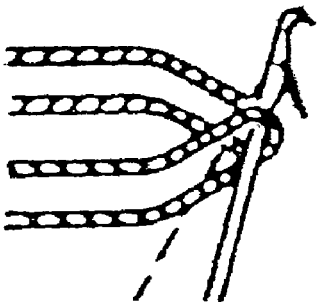
FIG. 5 shows a binding method with both a single latch needle and binder threads.
Figure 6:
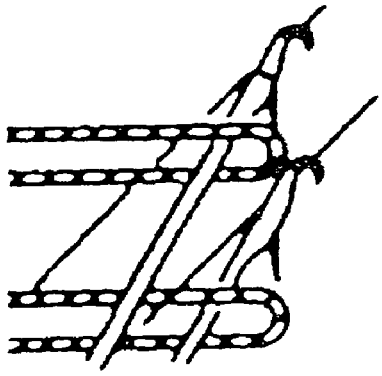
FIG. 6 shows a binding method with both double latch needles and double binder threads.

In addition, such a woven tape may also be formed by a binding method with both a single latch needle and binder threads as shown in FIG. 5, or a binding method with both a double latch needle and double binder threads, as shown in FIG. 6. The binding methods are not limited to those mentioned above and a larger number of ways of binding can be used for working this invention.

Figure 7:
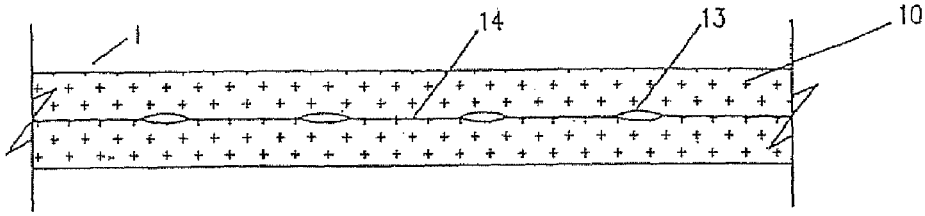
FIG. 7 shows an opened double-layer structure of a woven tape according to an embodiment of the present invention.
Figure 8:
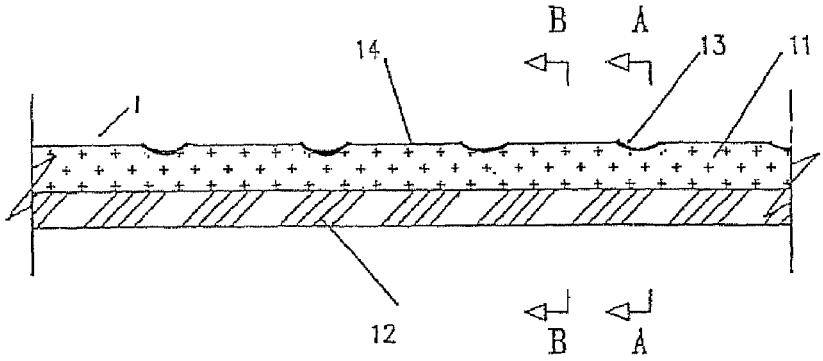
FIG. 8 shows the structure of a woven tape according to a further embodiment of the present invention.

According to a second embodiment of the present invention, and as shown in FIG. 7, the sealed double layer section of a woven tape according to the present invention may be cancelled and the lower edge of the original double-layer structure 11 is not sealed. The double-layer structure 11 is opened to form a main body 10 of a single-layer woven tape. At this time, the openings 13 and hooking positions 14 are now located along the centreline in the warpwise direction of the main body 10 of the woven tape.

The method of weaving this woven tape is basically identical to that discussed above, namely the lower section of the double-ply structure is not sealed and integrated with the opening positions and hooking positions by weaving. The double-layer structure so formed is then spread into the main body of a single-ply woven tape. In use, the tapes are superposed to attach the hooks onto the hooking positions 14.

It can be seen from the foregoing that a woven tape in accordance with the present invention is provided with a number of openings, (which serve as hook positions) which are integrally woven with the tape, and allow releasable engagement with hooks. Such simplifies the working procedure and reduces the number of seaming joints, thus reducing the possibility of loose ends at the seaming joints irritating the skin of a user. The hooks can be engaged with the openings according to the wish of the user, thus allowing change of locations of engagement of the hooks with the body of the bra. As these openings are hidden on the inner side of the bra, the bra remains simple and aesthetically pleasing. Such an arrangement allows the possibility of using or removing one or both of the shoulder straps, and allows the engagement of the shoulder straps at different locations of the bra body in accordance with the body shape and habits of the user, thus satisfying a large number of fashion needs of ladies.

What is claimed is:

1. A woven tape for use as a trimming of a brassiere, said woven tape being a single-layer woven tape, including a body portion provided with a plurality of openings along its warp wise centerline, wherein said openings are formed integrally with said woven tape by weaving and wherein said woven tape has a weaving structure represented by a 2-dimensional 8×6 matrix and wherein each of matrix elements (1,1), (1,4), (1,5), (2,2), (2,3), (2,6), (3,1), (3,4), (3,5), (4,2), (4,3), (4,6), (5,1), (5,4), (6,2), (6,3), (7,1), (7,4), (8,2), and (8,3) of said matrix represents that a warp yarn is between two weft yarns and wherein each of matrix elements (1,2), (2,1), (2,5), (3,2), (4,1), (4,5), (5,2), (6,1), (6,5), (6,6), (7,2), (8,1), (8,5), and (8,6) of said matrix represents that a warp yarn is above two weft yarns and wherein each of matrix elements (1,3), (1,6), (2,4), (3,3), (3,6), (4,4), (5,3), (5,5), (5,6), (6,4), (7,3), (7,5), (7,6), and (8,4) represents that a warp yarn is underneath two weft yarns.

2. A woven tape according to claim 1 wherein said tape is an elastic woven tape.

3. A woven tape according to claim 1 wherein said tape is a non-elastic woven tape.

4. A woven tape according to claim 1 wherein said tape is woven with at least a character, a pattern, a graphic design, a numeral or a letter.

* * * * *